United States Patent [19]

Page

[11] Patent Number: 4,774,725

[45] Date of Patent: Oct. 4, 1988

[54] FIREMAN'S COAT WITH LINER INDICATOR

[75] Inventor: Roger A. Page, Gilmanton, N.H.

[73] Assignee: Globe Manufacturing Company, Pittsfield, N.H.

[21] Appl. No.: 90,934

[22] Filed: Aug. 31, 1987

[51] Int. Cl.[4] ..... A41D 1/02; A41D 13/00

[52] U.S. Cl. ..... 2/81; 2/93; 2/97; 2/DIG. 6

[58] Field of Search ..... 2/81, 82, DIG. 6, 93, 2/97, 272, 85

[56] References Cited

U.S. PATENT DOCUMENTS 762,772 6/1904 Terramorse ..... 2/85

2,709,667 5/1955 Grubb et al. ..... 2/81 X 4,507,806 4/1985 Coombs ..... 2/97 X 4,709,421 12/1987 Grilliot et al. ..... 2/81

*Primary Examiner*—H. Hampton Hunter

*Attorney, Agent, or Firm*—Watson, Cole, Grindle & Watson

[57] ABSTRACT

The back section of the outer shell of a fireman's coat includes a slit therein and a strip of reflectorized material attached to the outer surface thereof near the slit and the liner which is removably attachable inside the outer shell includes a flap which can fit through the slit and cover the strip of fluorescent and reflective material so that an observer can tell whether or not the liner is in fact present inside the outer shell.

11 Claims, 3 Drawing Sheets

FIREMAN'S COAT WITH LINER INDICATOR

BACKGROUND OF THE INVENTION

1. FIELD OF THE INVENTION

The present invention relates to a fireman's coat which comprises a flame-resistant outer shell and a heat-resistant liner, the liner being removably attachable to the outer shell.

2. THE PRIOR ART

Protective suits which include coats comprised of an outer shell made of a fire-resistant material and a removable liner made of a heat-resistant material have been worn by firemen in and around fires for many years. However, because it is necessary to dress in great haste when preparing to fight a fire, a fireman may don the coat of his protective suit without taking the time to confirm that the heat-resistant liner is in fact attached inside the outer shell (in this regard, the liner may have been previously detached from the outer shell so that it can be dried or repaired). If it turns out that the liner is not attached inside the outer shell, the fireman may be severely injured by the heat of the blaze which he is fighting.

It is known to construct the outer shell of a fireman's coat to include either a fluorescent annular tab at its neck opening or a fluorescent annular area adjacent its neck opening, and to construct the removable liner thereof to include an annular flap which can cover the fluorescent annular tab or the fluorescent annular area of the outer shell when the removable liner is attached inside the outer shell—see U.S. Pat. No. 4,507,806. However, this known coat cannot be quickly and easily assembled because liner must be precisely aligned inside the outer shell in order for the flap thereof to fully cover the fluorescent annular tab or the fluorescent annular area (as the case may be) of the outer shell. In addition, because the annular tab or annular area of the outer shell utilizes a fluorescent material, it will be readily visible only during the daytime.

It is therefore an object of the present invention to provide a fireman's coat which includes a reliable indicator means for indicating whether or not the liner is in fact attached inside the outer shell, the indicator means being functional during daytime and nighttime conditions, and wherein the liner is quickly and easily attachable inside the outer shell.

SUMMARY OF THE INVENTION

According to the present invention the body portion of the outer shell of the fireman's coat, preferably the back section thereof, includes a liner-indicator means on the outer surface thereof, as well as a slot therethrough near the liner-indicator means, and the removable liner includes a flap which is capable of extending through the slot in the outer shell and extending over the liner-indicator means on the outer surface of the outer shell. With the flap covering the liner-indicator means, an observer can be assured that the proper liner is in fact attached inside the outer shell. On the other hand, if the liner-indicator means is visable to an observer, this is a clear indication that the proper liner is not attached inside the outer shell. In this latter situation, the fireman can be called away from the fire to have his coat inspected and the proper liner attached inside the outer shell. The liner-indicator means preferably includes a strip of fluorescent and reflective material.

The invention will now be better understood by reference to the accompanying drawings, taken in conjunction with the following discussion.

DETAILED DESCRIPTION OF THE PREFERRED EMBODIMENTS

A first preferred embodiment of a fireman's coat according to the present invention is shown in FIGS. 1–5. It is seen to include an outer shell 10 and a removable liner 30. The outer shell 10 is made of a fire-resistant material, such as Nomex® III aramid fibers (Nomex is a registered trademark of E.I. duPont de Nemours & Co., Wilmington, Del.), that has been treated with a water-repellant finish, and the removable liner 30 is made of an inner layer of heat-insulating material, such as a woven fabric or quilt made of Nomex® aramid fibers, and an outer layer of a vapor barrier material, such as Neoprene-coated cotton/-polyester.

Figure 1:
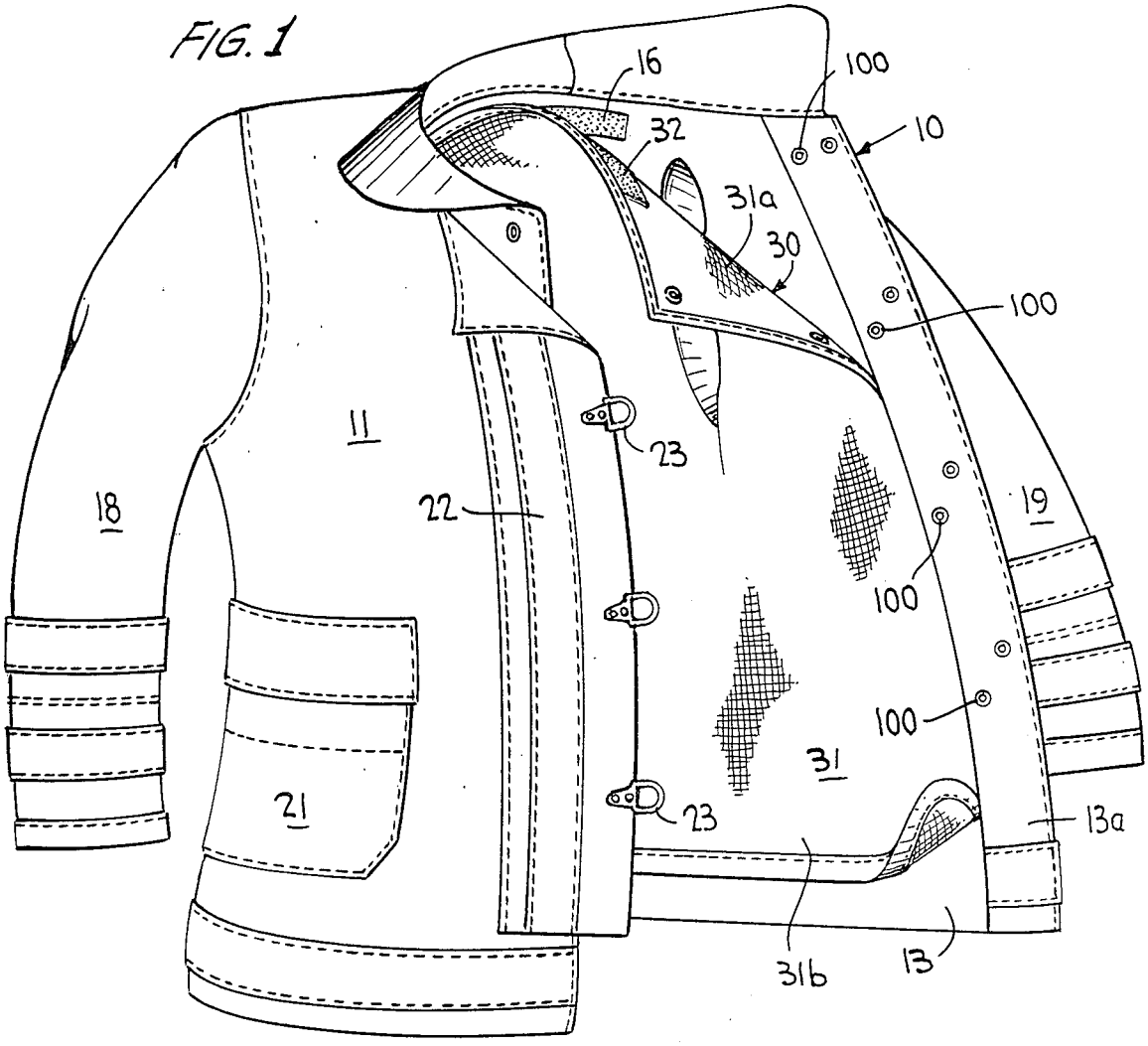
FIG. 1 is a perspective front view of an opened fireman's coat constructed according to a first preferred embodiment of the present invention, the coat comprising an outer shell and a removable liner therein, an upper corner of the removable liner being shown disconnected from the outer shell.
Figure 2:
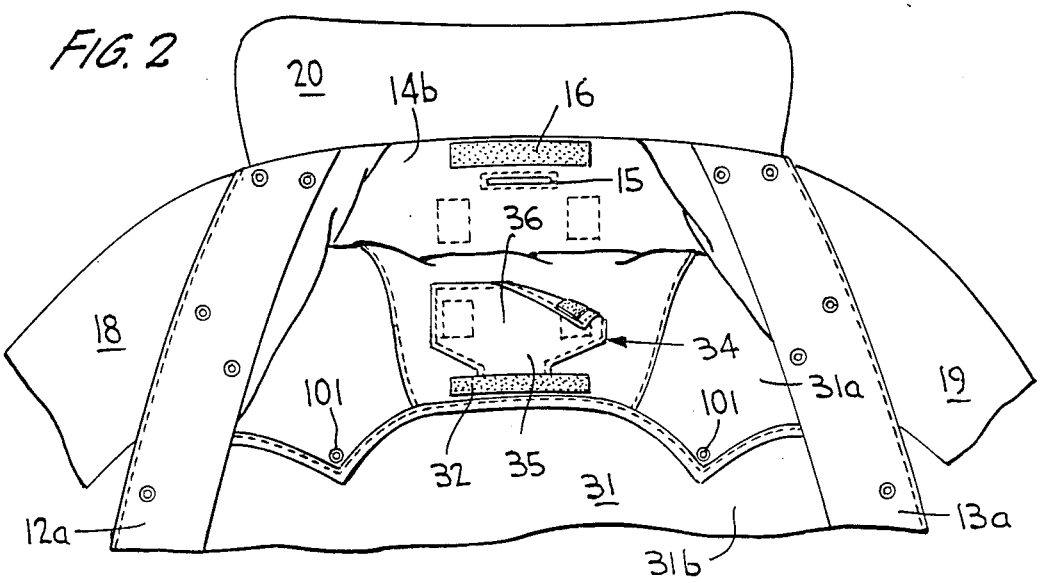
FIG. 2 is a front view of the upper portion of the fireman's coat shown in FIG. 1, the removable liner being shown partially disconnected from the outer shell and folded forwardly and downwardly with respect to the outer shell.
Figure 3:
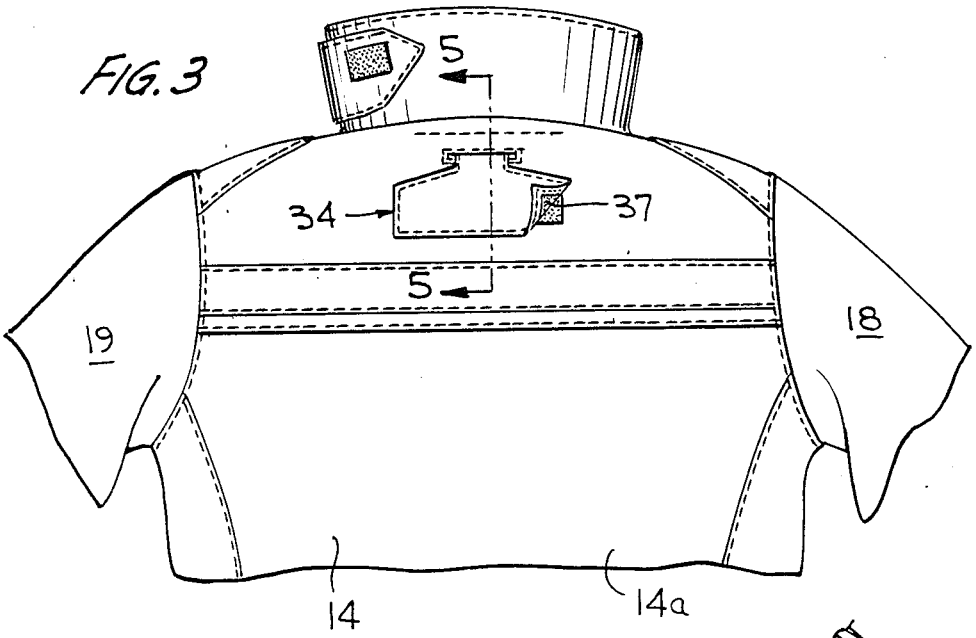
FIG. 3 is a rear view of the upper portion of the fireman's coat shown in FIG. 1.
Figure 4:
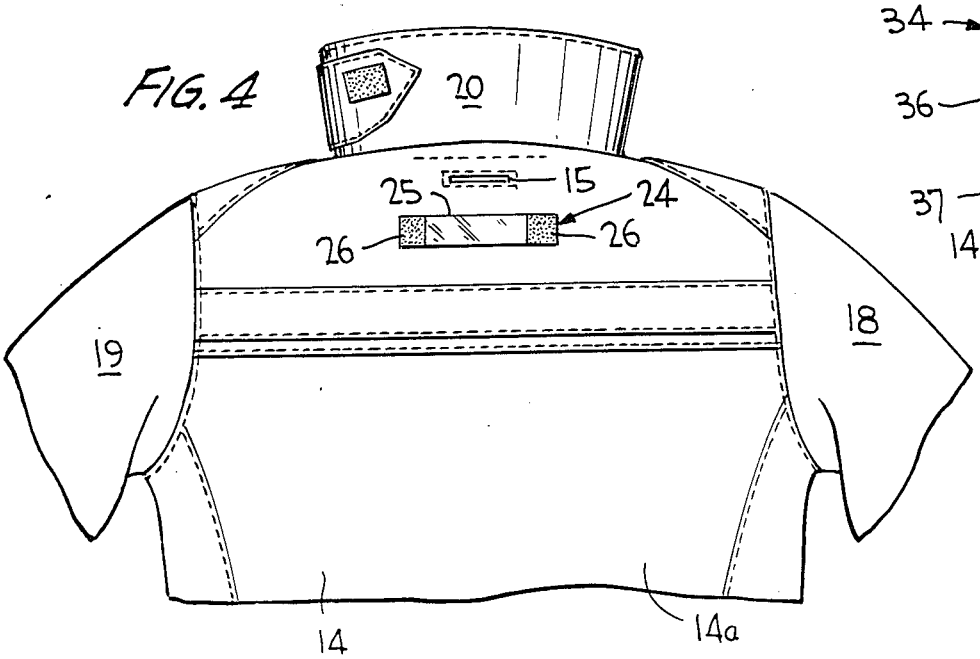
FIG. 4 is a rear view of the upper portion of the outer shell of the fireman's coat shown in FIG. 1.

As best seen in FIGS. 1, 2 and 4, the outer shell 10 is constructed of a body portion 11, a right sleeve 18, a left sleeve 19, a collar 20, pockets 21 (only one pocket is shown in FIG. 1), a closure panel 22 and a liner-indicator means 24 (see FIG. 4). The body portion 11 is itself formed of a right front body section 12, a left front body section 13 and a back section 14. The right and left front body sections include turned-in portions **12*a* and 13*a* that mount snap fastener base elements 100. The back section 14, which provides an outer surface 14*a* and an inner surface 14*b*, has a slit 15 therein just below the collar 20, e.g., about ½ to 6 inches therebelow. It also includes a Velcro® fastener strip 16 mounted on its inner surface 14*b* immediately below the collar 20**.

As best seen in FIG. 1, the closure panel 22 is connected to the right front body section 12 and includes eyes 23 that are cooperable with hooks (not shown) on the left front body section 13 to close the fireman's coat when in use.

The liner-indicator means 24 is attached to the outer surface 14*a* of the back section 14 below the slit 15. It includes a strip 25 of fluorescent and reflective material and respective Velcro ® pads 26 at the opposite ends of the strip 25. The fluorescent and reflective material is preferably made of green vinyl Refexite ®, which is readily viewable both during the daytime and at night. In this embodiment the strip 25 extends in parallel with the slit 15. The purpose and function of the strip 25 and the fastener pads 26 will become apparent below.

Figure 5:
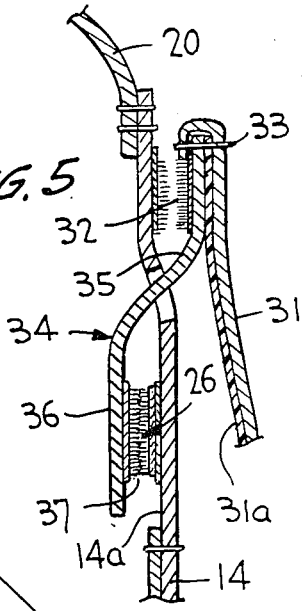
FIG. 5 is a cross sectional view of the fireman's coat as seen along line 5—5 in FIG. 3.

The removable liner 30 includes a body portion 31, which provides an outer surface 31*a* and an inner surface 31*b*. The body portion is shaped and sized so as to fit within the outer shell 10 and it includes snap fastener stud elements 101 for attachment to the snap fastener base elements 100 on the flap portions 12*a* and 13*a* of the outer shell 10. A Velcro ® fastener strip 32 is attached to the outer surface 31*a*. As seen in FIG. 5, the fastening strip 32 is attached along its upper edge to the body portion 31 by threads 33. This fastener strip 32 is attachable to the Velcro ® fastener strip 16 on the inside surface of the back section 14 of the outer shell 10. In addition, a generally T-shaped flap 34 having a shank portion 35 and a head portion 36 is attached to the outer surface 31*a* of the body portion 31 as can be seen in FIG. 5, the free end of the shank portion 35 being located between the fastener strip 32 and the outer surface 31*a* and attached to the body portion 31 via the threads 33. The width of the shank portion 35 is less than the width of the slit 15 in the back section 14 of the outer shell 10. The head portion 36 includes two Velcro ® fastener pads 37 on the surface thereof which, when the flap lies against the body portion 31, faces the body portion. These fastener pads are spaced apart by the same distance that the fastener pads 26 of the liner-indicator means 24 are spaced apart.

When the inventive fireman's coat as shown in FIGS. 1–5 is to be used, the removable liner 30 is positioned within the outer shell 10 and attached thereto by attachment of snap fastener stud elements 100 to snap fastener base elements 100 and attachment of the Velcro ® fastener strip 32 to the Velcro ® fastener strip 16. During this procedure the head portion 36 of the flap 34 is folded and extended through the slit 15 in the back section 14 of the outer shell 10 and then extended downwardly and over the liner-indicator means 24. It is then fixed in position by attachment of the Velcro ® fastener pads 37 to the Velcro ® fastener pads 26, concurrently covering the fluoresecent and reflective strip 25. In this way, the fluorescent and reflective strip 25 will not be visable to an observer, thereby providing an indication that the removable liner 30 is in fact present within the outer shell 10.

Figure 6:
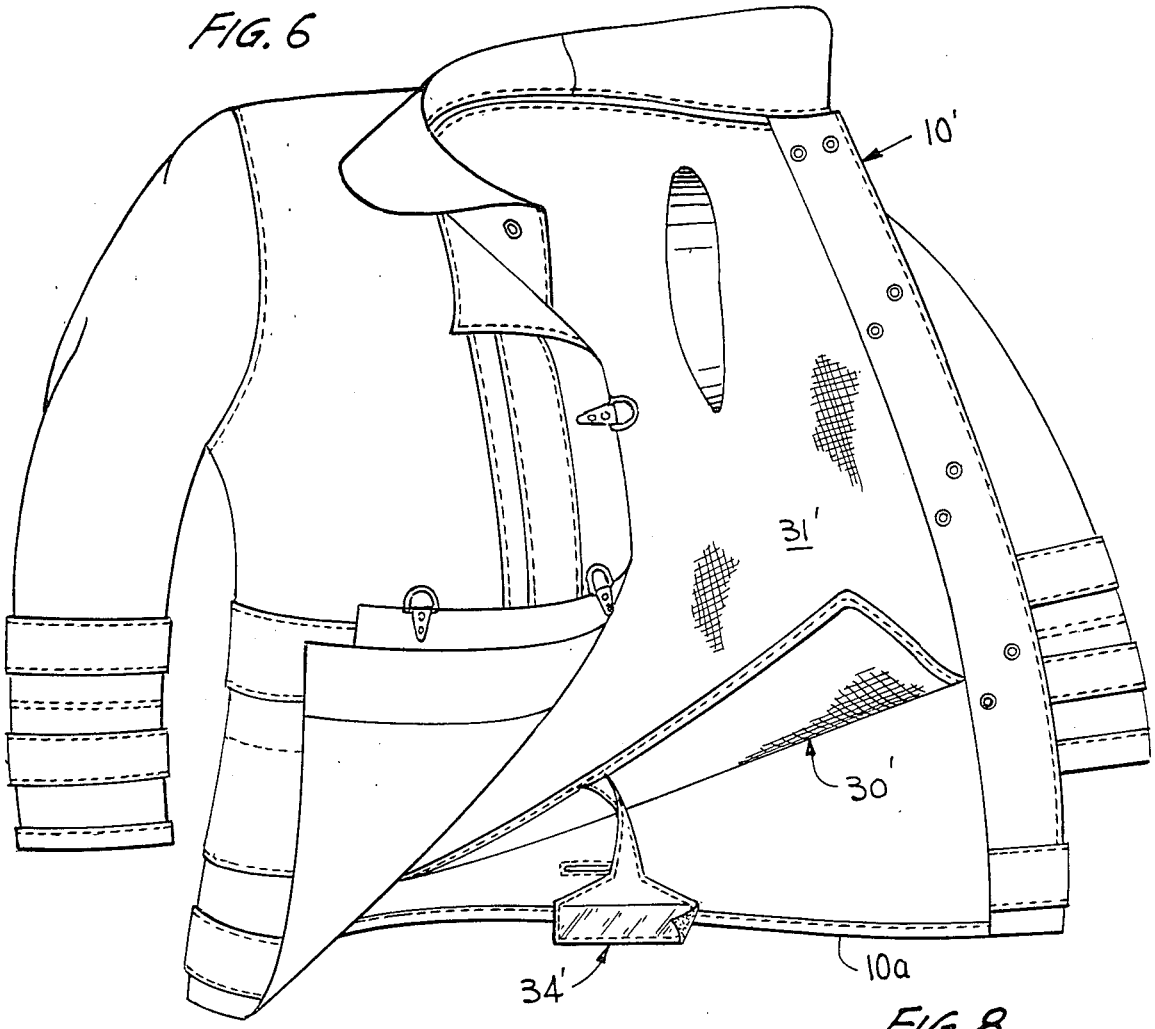
FIG. 6 is a perspective front view of an open fireman's coat constructed according to a second preferred embodiment of the present invention, the coat comprising an outer shell and a removable liner therein, the lower portion of the removable liner being shown disconnected from the outer shell and folded forwardly and upwardly with respect to the outer shell.
Figure 7:
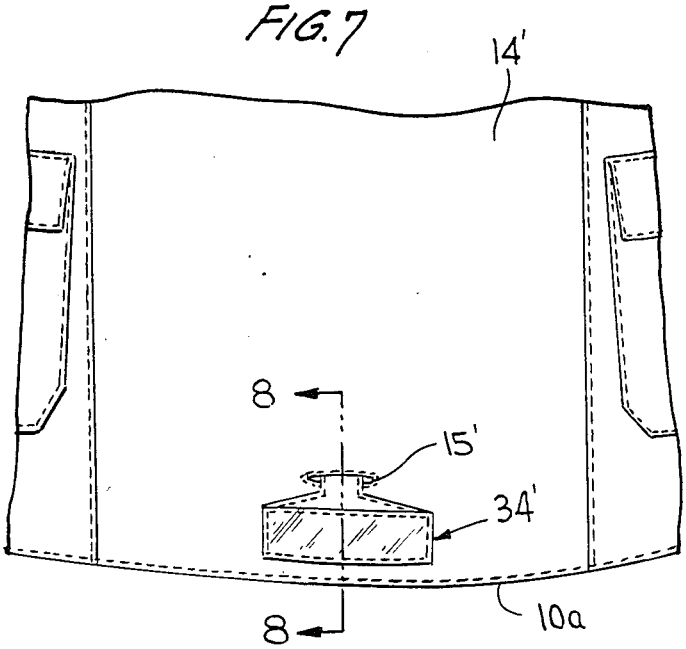
FIG. 7 is a rear view of the lower portion of the fireman's coat shown in FIG. 6, but wherein the lower portion of the removable liner is properly connected to the outer shell.
Figure 8:
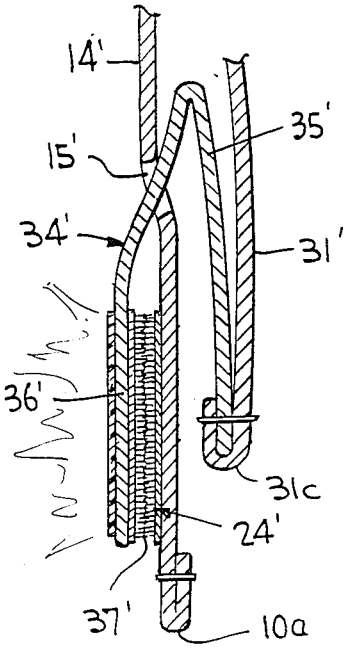
FIG. 8 is a cross sectional view of the fireman's coat, as seen along line 8—8 in FIG. 7.

FIGS. 6–8 show a second preferred embodiment of a fireman's coat according to the present invention. It can be seen that the slit 15′ in the back section 14′ of the outer shell 10′ is located just above the bottom edge 10*a* of the outer shell (e.g., between about 3 and 6 inches thereabove), and the liner-indicator means 24′ is located between the slit 15′ and the bottom edge 10*a*. The generally T-shaped flap 34′ is correspondingly connected to the body portion —′ of the removable liner 30′ near its lower edge 31*c*. In this embodiment, the Velcro ® fastener pads 37′ on the surface of the head portion 36′ of the flap 34′ which, when the flap lies against the body portion 31′ of the removable liner 30′, faces away from the removable liner (the shank 35′ is bent back to fit through the slit 15′). This embodiment is advantageous when the fireman wearing the coat must also carry certain types of breathing apparatus on his back.

Although two preferred embodiments of the present invention have been described in detail, various modifications therein can be made and still fall within the scope of the present invention.

I claim:

1. A fireman's coat which comprises an outer shell made of a fire-resistant material, said outer shell comprising a body portion, a right sleeve, a left sleeve, a collar and a liner-indicator means, said body portion including a right front body section, a left front body section and a back section, said back section having a slit therethrough and providing an outer surface and an inner surface, and said liner-indicator means being attached to the outer surface of said back section adjacent said slit, and a removable liner which is made of a heat-resistant material and which is attachable inside said outer shell, said removable liner including a body portion providing an outer surface and an inner surface and a flap attached to said body portion, said flap being capable of extending through said slit in the back section of said outer shell and covering said liner-indicator means when said removable liner is attached inside said outer shell, thereby providing an indication to an observer that the removable liner is in fact attached inside the outer shell.

2. The fireman's coat as defined in claim 1, wherein said liner-indicator means includes a strip of fluorescent and reflective material.

3. The fireman's coat as defined in claim 2, wherein said liner-indicator means also includes at least one fastener means adjacent to said strip of fluorescent and reflective material and wherein said flap includes at least one fastener means for connection to each said fastener means adjacent said strip of fluorescent and reflective material so as to fixedly position said flap over said strip of fluorescent and reflective material.

4. The fireman's coat as defined in claim 2, wherein said liner-indicator means includes two Velcro ® fastener pads at opposite ends of said strip of fluorescent and reflective material and wherein said flap includes two spaced apart Velcro ® fastener pads for connection to each of said Velcro ® fastener pads of said liner-indicator means so as to fixedly position said flap over said strip of fluorescent and reflective material.

5. The fireman's coat as defined in claim 4, wherein said flap has a generally T-shaped configuration.

6. The fireman's coat as defined in claim 1, wherein said slit is located in said back section of said outer shell just below the collar thereof, and wherein said liner-indicator means is located below said slit.

7. The fireman's coat as defined in claim 6, wherein said slit is located between about ½ and 6 inches below said collar.

8. The fireman's coat as defined in claim 6, wherein the strip of fluorescent and reflective material of said liner-indicator means is aligned in parallel with said slit.

9. The fireman's coat as defined in claim 1, wherein said slit is located above a bottom edge of the back section of said outer shell, and wherein said liner-indicator means is located between said slit and said bottom edge.

10. The fireman's coat as defined in claim 9, wherein said slit is located between about 3 and 6 inches above said bottom edge.

11. The fireman's coat as defined in claim 9, wherein the strip of fluorescent and reflective material of said liner-indicator means is aligned in parallel with said slit.

* * * * *